United States Patent [19]

Haraguchi

[11] Patent Number: 4,614,036

[45] Date of Patent: Sep. 30, 1986

[54] COMB ATTACHMENT FOR A HAIR CLIPPER

[75] Inventor: Hideaki Haraguchi, Hikone, Japan

[73] Assignee: Matsushita Electric Works, Ltd., Japan

[21] Appl. No.: 666,299

[22] Filed: Oct. 30, 1984

[30] Foreign Application Priority Data

Nov. 17, 1983 [JP] Japan ..... 58-216952

[51] Int. Cl.[4] ..... B26B 19/20; B26B 19/02

[52] U.S. Cl. ..... 30/200; 30/233.5

[58] Field of Search ..... 30/200, 201, 202, 233.5

[56] References Cited

U.S. PATENT DOCUMENTS

| | | | |
|---|---|---|---|
| 2,256,076 | 9/1941 | Coles | 30/200 X |
| 2,747,277 | 5/1956 | Esposito | 30/200 |
| 3,041,726 | 7/1962 | Hitson | 30/201 |
| 3,178,815 | 4/1965 | Madrid . | |
| 3,344,520 | 10/1967 | Williams | 30/200 |

FOREIGN PATENT DOCUMENTS 137478 9/1922 Japan .

*Primary Examiner*—Donald R. Schran

*Attorney, Agent, or Firm*—Stevens, Davis, Miller & Mosher

[57] ABSTRACT

A novel comb attachment for use with a hair clipper is disclosed herein. The comb attachment is adapted to fit over the front portion of the hair clipper including a cutter assembly having an elongated cutting edge. The cutter assembly comprises a movable cutter reciprocating with respect to a stationary cutter, these cutters defining therebetween a cutting plane. Formed in the front end of the attachment is a series of spaced comb teeth the row of which is in close and parallel relationship with the cutting edge of the cutter assembly for guiding hairs into the cutting edge. Each of the comb teeth is formed at the location above the cutting plane with at least one barb projecting on its side and upper faces to define therebehind a rearwardly oriented shoulder. These shoulders act as stoppers for the clipped hair strands which have been sheared and fed rearwardly of the cutting edge when advancing the hair clipper through a user's hair for a continuous hair cut. Accordingly, the clipped hair strands can be well prevented from gliding back to the tips of the comb teeth and into the cutting edge during the advancing movement of the hair clipper, whereby assuring a smooth cutting action which is free from the reentry of the clipped hair strands in the cutting edge, while retaining a smooth combing action by the comb teeth.

1 Claim, 10 Drawing Figures

COMB ATTACHMENT FOR A HAIR CLIPPER

BACKGROUND OF THE INVENTION

1. Field of the Invention

The present invention is directed to a comb attachment for a hair clipper, and more particularly to a comb attachment adapted to fit over a hair clipper for smoothing and guiding hairs into cutting engagement with a cutting edge of the hair clipper.

2. Description of the Prior Art

Various comb attachments for a hair clipper have been proposed as disclosed, for example, in Japanese early publication of the utility model application (KOKAI) No. 54-137478 and in U.S. Pat. No. 3,178,815. These prior art attachments are designed to have a plurality of spaced comb teeth each having a generally same width along the length thereof from its root to tip and having a generally flat or smooth upper surface. When advancing the hair clipper with such attachment across the scalp for a hair cutting operation, some of clipped hair strands will gather or remain in the root portions of said comb teeth and are likely to glide along the comb teeth back to the tips thereof during the continuous cutting operation so that they may reenter in cutting engagement with the cutting teeth. This possibly renders the cutting teeth to jam or to be clogged with the clipped hair strands and therefore may largely detract from the normal cutting operation by the cutting teeth, thus resulting in poor cutting performance or in an uneven cut.

SUMMARY OF THE INVENTION

The above disadvantage has been eliminated in the present invention which discloses a novel comb attachment adapted to fit over the front portion of a hair clipper adjacent an elongated cutting edge of the hair clipper for smoothing and guiding hairs into cutting engagement therewith. The cutting edge is formed by a toothed stationary cutter and a toothed movable cutter driven to reciprocate with respect thereto and these toothed cutters define therebetween a cutting plane. The comb attachment includes an upper surface positioned above said cutting plane and a bottom surface below the cutting plane, said bottom surface being inclined with respect to the upper surface and serving as a scalp contacting surface. These upper and lower surfaces merging at the front end of the attachment to define thereat a front corner section with a leading edge which is in close and parallel relationship with said elongated cutting edge of the hair clipper. Said front corner section is slotted to form a series of spaced comb teeth which are arranged in the lengthwise direction of said leading edge to define between the adjacent comb teeth hair introducing slots. Each of the comb teeth spans between the upper and bottom surfaces and is formed at the portion above said cutting plane with at least one barb projecting on its side and upper faces to define therebehind a rearwardly oriented shoulder. These shoulders act as stoppers for the clipped hair strands which have been sheared and fed rearwardly of the cutting edge as the hair clipper is advanced through a user's hair. That is, the shoulders are responsible for precluding the clipped hair strands from gliding back to the tips of the comb teeth and into the cutting edge during the advancing movement of the hair clipper, thereby giving rise to clog-free hair cutting.

Accordingly, it is a primary object of the present invention to provide a comb attachment for a hair clipper capable of providing a smooth and efficient hair cutting without the user being annoyed by the clipped hairs.

In a preferred embodiment, the barb is formed at the front end of each comb teeth and has its side and upper faces tapering toward its tip along the length thereof so as to smoothly guiding the hairs into the cutter edge.

It is therefore another object of the present invention to provide a comb attachment for a hair clipper which assures a smooth and efficient combing action, yet preventing the reentry of the clipped hair strands into the cutting edge.

These and other objects of the present invention will be apparent from the following description of the preferred embodiment when taken in conjunction with the accompanying drawings.

DETAILED DESCRIPTION OF THE PREFERRED EMBODIMENT

Figure 1:
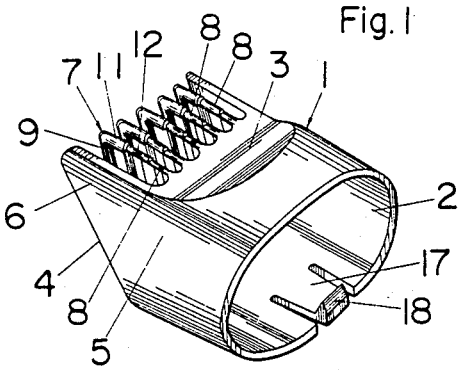
FIG. 1 is an exploded view of a hair clipper and a comb attachment therefor in accordance with a preferred embodiment of the present invention.
Figure 1:
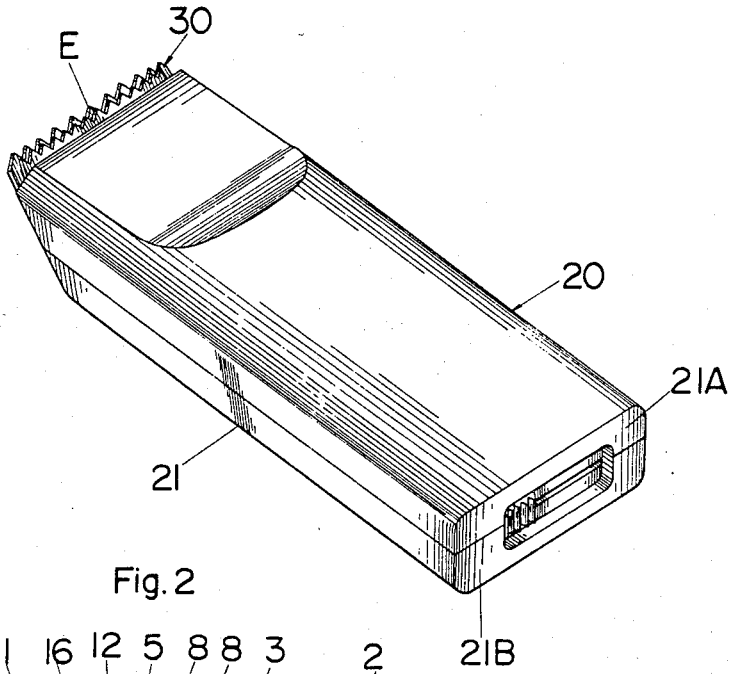
Figure 2:
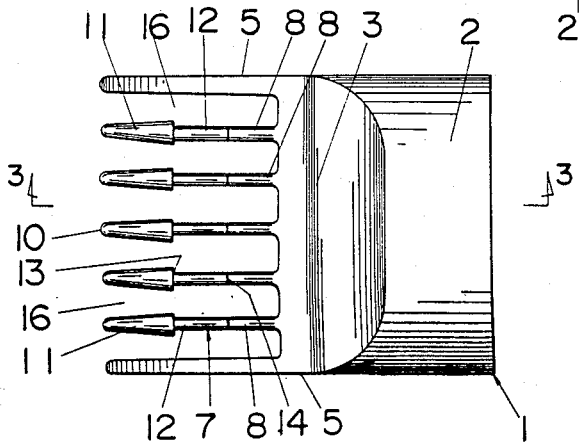
FIG. 2 is a top view of the comb attachment.
Figure 3:
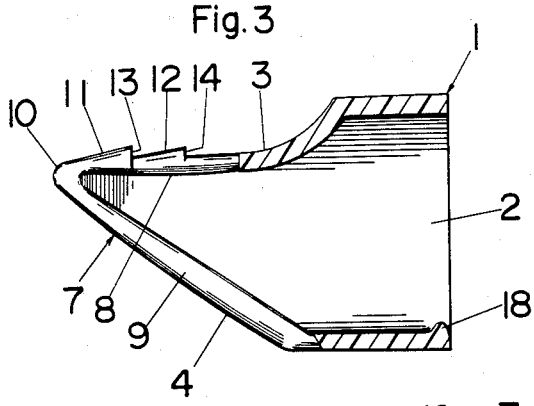
FIG. 3 is a cross section taken along line 3—3 of FIG. 2.
Figure 6:
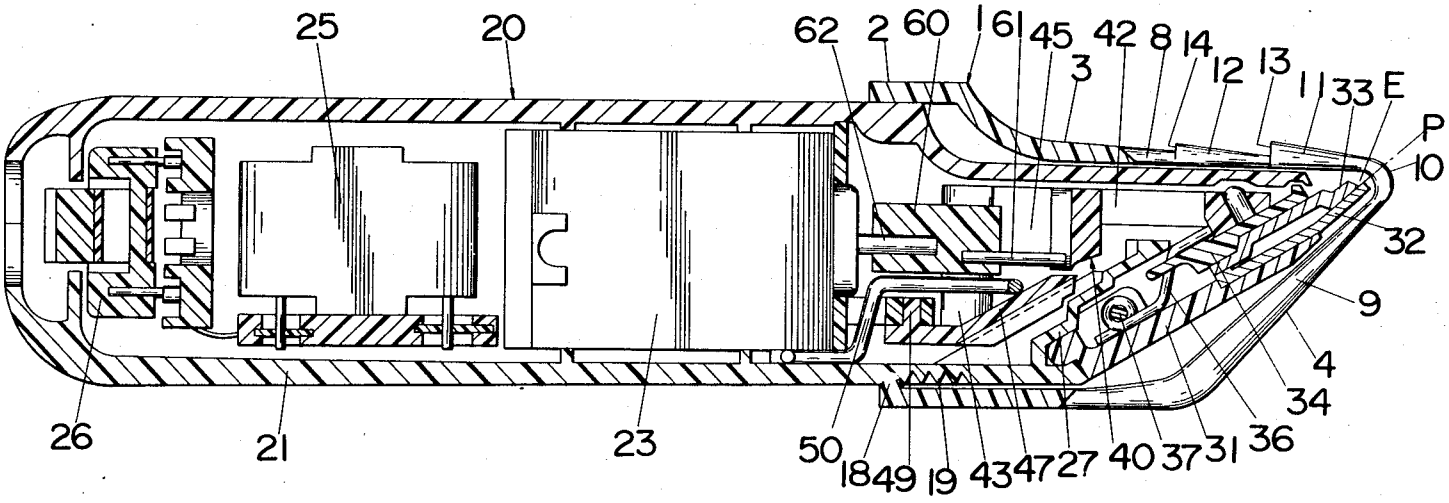
FIG. 6 is a longitudinal section of the hair clipper.
Figure 7:
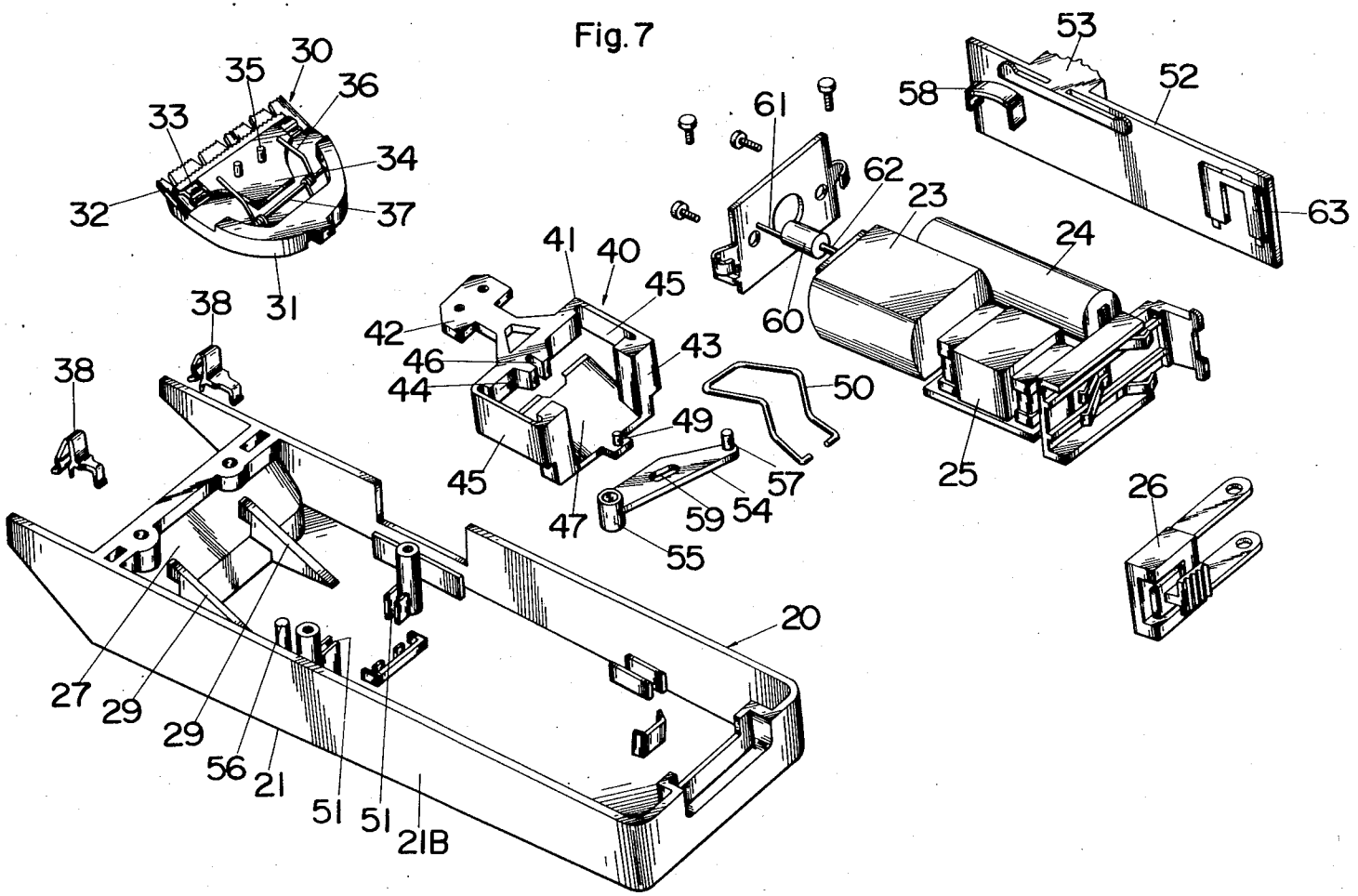
FIG. 7 is a partial exploded perspective view of the hair clipper with the comb attachment and an upper half of the hair clipper housing being removed.

Referring now to FIG. 1, there is shown a comb attachment 1 adapted to be fit over the front portion of an electric hair clipper 20 with a cutter assembly 30 at its front end. The hair clipper 20 comprises an elongated housing 21 composed of an upper and lower halves 21A and 21B and is electrically powered by a motor 23 mounted in the middle portion of the housing 21. As shown in FIGS. 6 and 7, the motor 23 is energized by a rechargeable battery 24 received in the housing 21 and chargeable by a conventional AC power source through a charging circuit 25 also received in the housing 21. For this purpose, the housing 21 is provided with a retractable plug 26 to be inserted in a domestic AC outlet for supplying electric power to the battery 24 therefrom.

Said cutter assembly 30 includes a toothed stationary cutter 32 mounted on a cutter support 31 and a toothed movable cutter 33 disposed on the stationary cutter 32 to be in reciprocating relation with respect thereto, these cutters 32 and 33 being in cooperation with one another to form an elongated cutting edge E and defining therebetween a cutting plane P. The movable cutter 33 is carried by a holder 34 which is operatively connected to the motor 23 through a drive element 40 so as to be driven thereby to reciprocate together with the movable cutter 33, the movable cutter 33 being urged against the stationary cutter 32 by a pair of torsion springs 36 each having one end in urging contact with the holder 34 and the other end supported by a rod 37 fixed on the cutter support 31. The cutter support 31 is disposed outside of an upwardly slanting front bottom wall 27 of the housing 21 and is mounted thereon by means of clips 38 such that said elongated cutting edge E of the cutter assembly 30 projects forwardly of the front end of the housing 21 and extends transversely of a longitudinal axis of the housing 21 as well as that said cutting plane P is inclined with respect to a plane normal to that axis, as best shown in FIG. 6.

Said drive element 40 disposed within the housing 21 is made of a plastic material and comprises a frame 41 and a drive arm 42 extending forwardly therefrom for connection with said holder 34 secured to the movable cutter 33. The frame 41 is in generally rectangular configuration comprising a rear rigid segment 43, a front rigid segment 44 from which the drive arm 42 extends, and resilient side legs 45 integrally connect the above front and rear rigid segments 43 and 44 so as to allow the front segment 43 and the drive arm 42 to move sidewards within a limited extent with respect to the rear rigid segment 43 which is laterally fixed within the housing 21. A collar 60 with an eccentric pin 61 is fixed on an output rotor shaft 62 of the motor 23 and extends through an opening in said rear rigid segments 43 so that the eccentric pin 61 is slidably received in a vertically elongated slit 46 for establishing a drive connection between the motor 23 and the drive element 40, whereby upon rotation of the motor 23 the drive element 40 converts the rotational motion of the output rotor shaft 62 into a reciprocating motion of the movable cutter 33.

Figure 5:
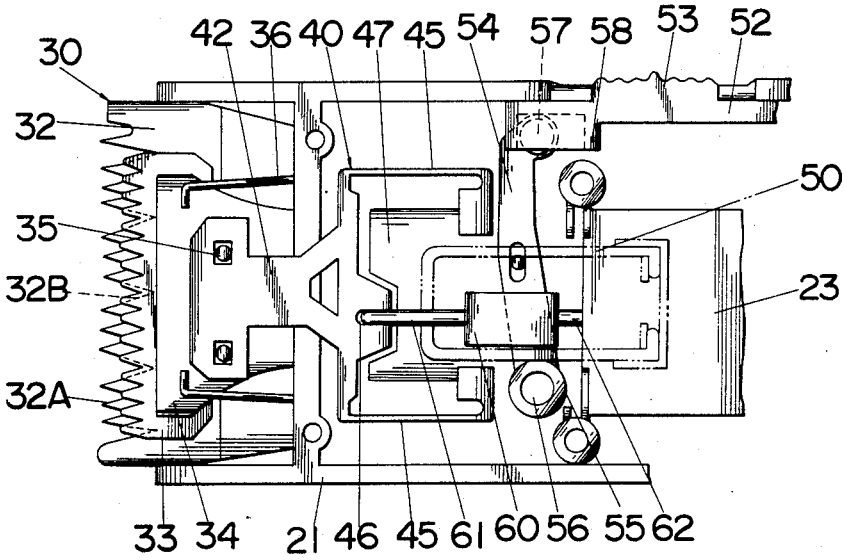
FIG. 5 is a partial plan view showing a driving mechanism of a cutter assembly incorporated in the hair clipper.

Said drive element 40 is slidably mounted within the housing 21 with its inclined bottom skirt 47 in sliding engagement with inclined surfaces of a pair of laterally spaced and longitudinally extending guide ribs 29 on the inner bottom of the lower half 21B of the housing 21 so as to be movable along the longitudinal axis thereof. Similarly, the movable cutter 33, which is connected to the drive element 40 by inserting pins 35 on the holder 34 into corresponding apertures in the drive arm 42, is held slidably on the stationary cutter 32 so as to be movable together with said drive element 40 between two longitudinally spaced positions, one for a cutting position and the other for a thinning position. At the cutting position, the movable cutter 33 is in its forwardmost position to have its toothed edge in alignment with a series of short toothed edge 32A for cutting hairs between the toothed edges, as best shown in FIG. 5. On the other hand, when the movable cutter 33 retards rearwardly to the thinning position the toothed edge of the movable cutter 33 is in alignment with spaced long or deep toothed edge 32B partially formed in said short toothed edge 32A for reducing the bulk of hair. A U-shaped spring 50 is secured to the housing 21 by fixedly inserting the free end portions in corresponding grooves 51 to have a web portion thereof in pressing abutment with said inclined bottom skirt 47 of the drive element 40 for preventing the lifting of the same.

The switching between said cutting and thinning positions is made by manipulating a three position selector plate 52 which is slidably held within the housing 21 with an operating knob 53 on the outer side thereof projecting outwardly of the housing 21 and which is connected to the drive element 40 by means of a lever 54. The lever 54 has its one end a sleeve 55 receiving therein a post 56 projecting on the bottom of the housing 21 so that it pivots about the axis of the post 56. A stud 57 at the other end of the lever 54 engages a catch 58 on the inner surface of the selector plate 50 to be connected thereto. Formed in the middle portion of the lever 54 is an elongate slot 59 which receives a peg 49 at the rear end of the drive element 40, whereby the sliding movement of the selector plate 52 causes the lever 54 to pivot for movement of the drive element 40 along the longitudinal axis of the housing 21 so that the movable cutter 33 connected to the drive element 40 is selectively moved between the above two positions. Provided at the rear end of the selector plate 52 is a contact plate 63 which is arranged to electrically disconnect the motor 23 from the battery 24 only when the plate 52 is in the intermediate position. That is, when the plate 52 is moved forwardly to select the above cutting position and when moved rearwardly to select the thinning position, the motor 23 is in electrical connection with the battery 24 for driving the movable cutter 33, while the motor 23 is disconnected from the battery 24 when the plate 52 is moved to the intermediate position.

Turning back to FIG. 1 and further referring to FIGS. 2 through 4 and 6, said comb attachment 1 is made as an integral unit of a suitable plastic material and is configured to be a cup-like member with a rearward disposed cylindrical section 2 adapted to snugly fit over the front portion of the housing 21 of the hair clipper 20. The comb attachment 1 comprising an upper surface 3 shaped somewhat from a flat surface into a concavely curved surface, a generally flat bottom surface 4, and side surfaces 5 all integrally extending forwardly from said cylindrical section 2 to blend circumferentially into a front cap section conforming to the contour of the front end portion of said housing 21. Said bottom surface 4 is inclined with respect to the general upper surface 3 and serves as a scalp contacting surface which moves across the scalp during the operation of the hair clipper 20. The upper and bottom surfaces 3 and 4 merge at the front end of the attachment 1 to define thereat a front corner section 6 with a transversely extending leading edge which is to be in close and parallel relationship with said cutting edge E of the cutter assembly 30 when the attachment 1 is attached to the hair clipper 20. Said front corner section 6 of the comb attachment 1 is slotted to form a series of transversely spaced comb teeth 7 each bridging the upper surface 3 and the bottom surface 4 to have a generally V-shaped configuration composed of an upper stem 8 and a lower stem 9 connected at a rounded ridge or tip 10 on said leading edge. Said comb teeth 7 are equally spaced in parallel relationship with each other to define the adjacent teeth hair introducing slots 16 of substantially the same width and are arranged to have the upper stems 8 located above said cutting plane P of the cutter assembly 30 and at the same time to have the lower stem 9 below that cutting plane P.

Figure 4:
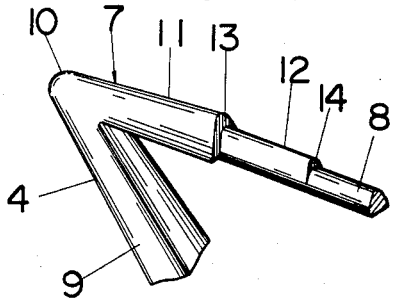
FIG. 4 is an enlarged perspective view showing a part of a comb tooth of the comb attachment.

The upper stem 8 of each comb tooth 7 is formed with a first barb 11 and a second barb 12 which are longitudinally aligned but have no downwardly projecting portion so as to present a smoothly finished surface on the lower surface of the upper stem 8. This smooth surface is brought into an intimate relation with the upper surface of the front end portion of the housing 21, as best shown in FIG. 6. Said first barb 11 is configured to project both on the side and upper faces of the stem 8 to define therebehind a first rearwardly oriented shoulder 13, the side and upper surfaces of the first barb 11 tapering forwardly into the rounded tip 10. Said second barb 12 is configured to project only on the upper face of the stem 8 to likewise define therebehind a second rearwardly oriented shoulder 14 spaced rearwardly from the first shoulder 13, as best shown in FIG. 4.

Figure 10:
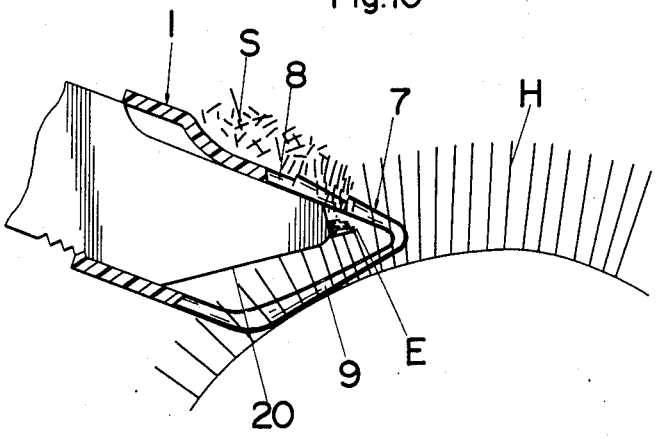
FIG. 10 is a schematic view illustrating the hair clipper fitted with the comb attachment in its actual cutting operation.

In the operation of the comb attachment thus constructed, the comb teeth 7 comb or guide hairs H smoothly into the cutting edge E of the cutter assembly 30 for the above cutting or thinning purpose as advancing the hair clipper 10 through the hairs H for a continuous operation, during which the above shoulders or steps 13 and 14 serve as stops for retaining clipped hair strands S therebehind so as to prevent the same from gliding along the comb teeth 7 back to the tips 10 and into the cutting edge E, as shown in FIG. 10. Thus, the clipped hair strands S will be fed rearwardly as the operation is continued to fall off from the sides of the hair clipper 20 without gliding back to the cutting edge, precluding reentrance of the clipped hair strands into the cutting edge so that the efficient cutting or thinning by the cutter assembly 30 free from being clogged with the hair strands can be maintained during the continuous cutting or thinning operation.

Figure 8:
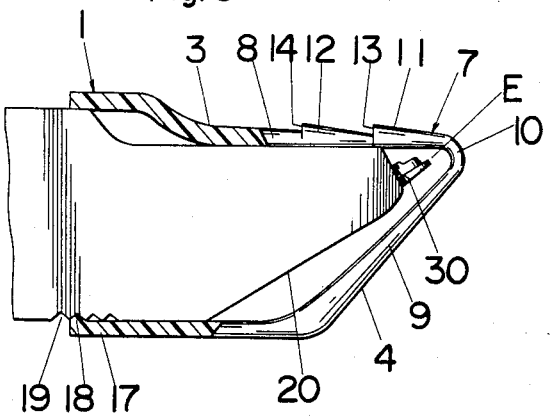
FIGS. 8 and 9 are explanatory views of the comb attachment in its different use positions relative to the hair clipper, respectively.
Figure 9:
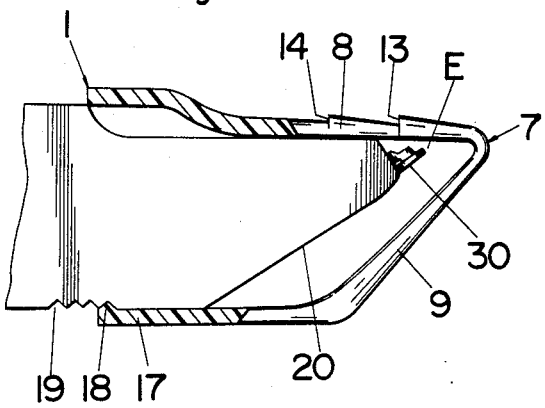

Formed at bottom of said rearward disposed cylindrical section of the comb attachment 1 is an integral resilient tab 17 with a hook 18 which is selectively engageable with one of longitudinally aligned serrated teeth 19 for adjusting the distance between the cutting edge E and the lower stems 9 of the comb teeth 7 which are to be in contacting engagement with the scalp during the operation of the hair clipper 20. When a relatively close cut is desired, the comb attachment 1 is disposed closer to the hair clipper 20 so as to shorten that distance, as shown in FIG. 8. On the other hand when a trimming is desired, the comb attachment 1 is positioned at a remote position from the clipper 20 so as to lengthen that distance, as shown in FIG. 9.

What is claimed is:

1. A comb attachment for fitting over the end of the cutter assembly of a hair clipper having a transversely extending leading edge on the cutter assembly, said comb attachment comprising:

an upper surface and a lower surface positioned to lie parallel to the surfaces of the cutter assembly when installed thereover, said surfaces meeting at the front end portion of the attachment to define a front corner section which is close to and parallel with the leading edge of the cutter assembly when fitted thereover;

said front corner section having a plurality of slots forming hair introducing comb teeth leading into the cutter assembly;

the comb teeth each having an upper stem and a lower stem, said upper stems having a first barb configured to project both on the sides and upper surface of the upper stem to define therebehind a first rearwardly oriented shoulder, and the outer surfaces of said first barb tapering toward a tip lying on the front corner section; said upper stems further having second barbs spaced away from the front corner section and configured to project only on the upper face of the upper stem to define a second rearwardly oriented shoulder, the height of the second shoulder above the stem being less than the height of the first shoulder above said stem.

* * * * *